US007250014B2

(12) United States Patent
Trowers

(10) Patent No.: US 7,250,014 B2
(45) Date of Patent: Jul. 31, 2007

(54) IRREGULAR BOUNCE BALL AND GAME

(76) Inventor: Alvin A. Trowers, 1900 NE. 86th Ter., Pembroke Pines, FL (US) 33024

( * ) Notice: Subject to any disclaimer, the term of this patent is extended or adjusted under 35 U.S.C. 154(b) by 0 days.

(21) Appl. No.: 11/142,592

(22) Filed: Jun. 1, 2005

(65) Prior Publication Data

US 2006/0276278 A1 Dec. 7, 2006

(51) Int. Cl.
*A63B 43/00* (2006.01)

(52) U.S. Cl. ..... 473/595

(58) Field of Classification Search ..... 473/451, 473/595, 596; 119/707
See application file for complete search history.

(56) References Cited

U.S. PATENT DOCUMENTS

| | | | | |
|---|---|---|---|---|
| 652,993 | A | 7/1900 | Burt | 40/327 |
| D54,903 | S | 4/1920 | Eddy | 21/713 |
| 1,771,861 | A | 7/1930 | Penfold | 156/81 |
| 2,078,382 | A * | 4/1937 | Hanshaw | 473/595 |
| 3,439,917 | A | 4/1969 | Gentile | 473/52 |
| 3,740,036 | A | 6/1973 | Ames | 473/569 |
| 3,917,271 | A | 11/1975 | Lemeslon et al. | 473/573 |
| 5,048,829 | A | 9/1991 | Prokupek | 473/595 |
| D379,105 | S | 5/1997 | Wilk | 21/714 |
| D456,959 | S | 5/2002 | Simon | 30/160 |
| D520,579 | S * | 5/2006 | Trowers | D21/713 |

FOREIGN PATENT DOCUMENTS

| | | | |
|---|---|---|---|
| GB | 2091110 | A | 7/1982 |
| GB | 2145630 | A * | 4/1985 |
| WO | 2004/002583 | A1 * | 8/2004 |

* cited by examiner

*Primary Examiner*—Steven Wong
(74) *Attorney, Agent, or Firm*—Robert C. Kain, Jr.; Fleit Kain

(57) ABSTRACT

The generally spherical handball includes a first spherical surface portion at a common radial distance from the ball center and a second spherical surface portion at a second common radial distance. In a preferred embodiment, a third surface portion is defined at the second radial distance. A curvilinear edge is formed at the abutment of the first, second and third surface portions. Dependent upon where the surface of the ball strikes the playing surface, the ball bounces irregularly. To enhance the irregularity of the play, the second and third surfaces are surfaces of two semi-spherical domes and each semi-spherical dome has a hollow core region.

6 Claims, 1 Drawing Sheet

IRREGULAR BOUNCE BALL AND GAME

The present invention relates to a generally spherical handball which has an irregular bounce and a game or method of play with the irregular bounce handball.

BACKGROUND OF THE INVENTION

Handballs are widely used for many types of games. A basic handball game involves tossing or throwing the handball at a surface, viewing the bounce of the ball off that surface and sometimes watching the ball bounce off a second surface and then catching the ball. However, this type of game quickly becomes monotonous because most handballs bounce with certainty and exhibit regular operational properties and characteristics. It is beneficial to develop a handball which has a irregular bounce to challenge the player of a ball game.

OBJECTS OF THE INVENTION

It is an object of the present invention to provide a handball which has a irregular bounce.

It is a further object of the present invention to provide a handball which has first, second and third spherical surface portions and a pair of curvilinear edges at the abutment of these surface portions causing the ball to irregularly bounce based upon which ball surface, the first, second or third surface portions or the edge region, strikes the playing court.

SUMMARY OF THE INVENTION

The generally spherical handball includes a first spherical surface portion at a common radial distance from the ball center and a second spherical surface portion at a second common radial distance. In a preferred embodiment, a third surface portion is defined on the handball at the second radial distance. A curvilinear edge is formed at the abutment of the first, second and sometimes third spherical surface portions. Dependent upon the contact area of the ball and the playing surface, the ball bounces irregularly. To enhance the play and irregularity, the second and preferably the third spherical surfaces are surfaces formed on two semi-spherical domes and each semi-spherical dome has a hollow core region.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to an irregular bounce ball and a method of playing a game with the irregular bounce ball.

Figure 1:
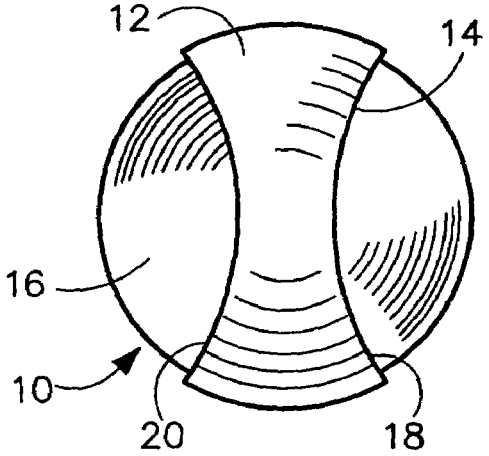
FIG. 1 diagrammatically illustrates a top view of the irregular bounce ball.
Figure 2:
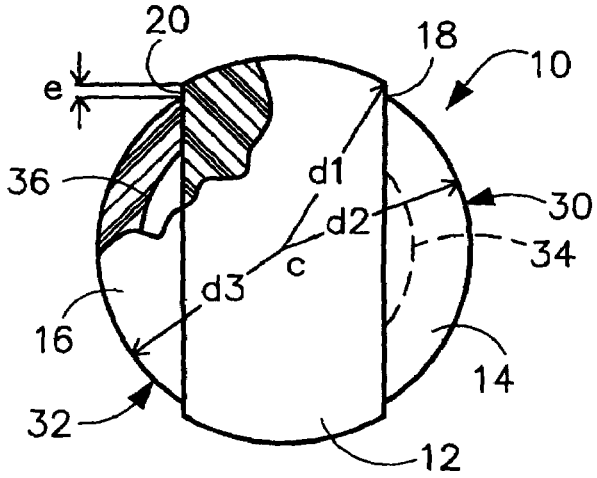
FIG. 2 diagrammatically illustrates a side elevational view of the irregular bounce ball and a partial, broken away view of an interior portion of the irregular bounce ball.
Figure 3:
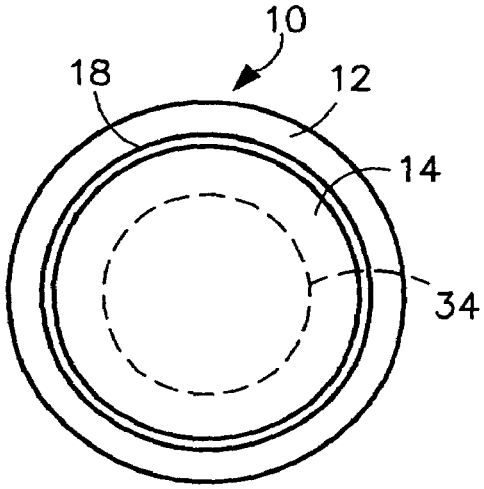
FIG. 3 diagrammatically illustrates a rear view of the irregular bounce ball.

The figures are described concurrently herein and similar numerals designates similar items throughout all the figures. Irregular bounce ball 10 is a generally spherical handball, approximately 2-3 inches in diameter. Ball 10 has a first spherical surface 12 having a first common radial distance d1 (FIG. 2) from center point c of the ball. Ball 10 also includes a second spherical surface 14 having a second common radial distance d2 from center point c of ball 10. In a preferred embodiment, ball 10 includes a third spherical surface portion 16 having a third common radial distance d3 from center point c. In the preferred embodiment, radial distance d2 is equal to radial distance d3. At the surface of ball 10, a curvilinear edge 18 is formed at the abutment of surfaces 12 and 14. The height e of edge 18 is less than 5% of radial distance d2. Further, another edge 20 is formed at the abutment between third spherical surface portion 16 and first spherical surface portion 12.

To enhance the irregular bounce of ball 10, second and third spherical surface portions 14, 16 are the surfaces of two semi-spherical domes 30, 32. Each of these semi-spherical domes 30, 32 has a hollow core region 34, 36. Preferably, the interior ball body beneath first spherical surface portion 12 is compressed, resilient rubber or plastic and the semi-spherical domes 30, 32 are also made of the same compressed resilient rubber or plastic but the semi-spherical domes 30, 32 include a hollow core 34, 36.

Figure 4:
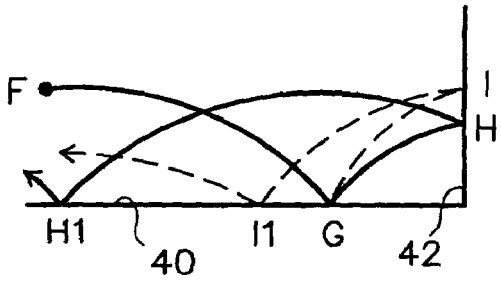
FIG. 4 diagrammatically illustrates a method of playing a ball game with the irregular bounce ball and the irregular bounce pattern generated by the ball.

FIG. 4 diagrammatically illustrates when ball begins play at point F directed at first surface 40. The ball, in one play cycle, follows the solid line and bounces from point G on surface 40 to point H on surface 42. During another play cycle, a ball which is tossed or thrown from point F to point G follows the dashed projectile path from point G on surface 40 and strikes surface 42 at point I. Subsequent bounces from surface 42 back to surface 40 result in the ball striking points H1 and I1 which are dramatically different than the first play cycle when the ball strikes at points G, H and H1. Therefore, the player is continually challenged to try and catch the ball since the ball bounces irregularly from surfaces 40, 42.

It should be noted that the radial distance d2 and d3 of surfaces 14, 16 may be different which results in a more irregular bounce pattern since the amount of compressible resilient plastic or rubber is different (the dome height being different) and the height of edge 18 compared with edge 20 is different. Further, the size and shape of hollow cores 34, 36 may be changed and this differential hollow volume also causes ball 10 to bounce in a more irregular pattern from surfaces 40, 42. Further, the user would not necessarily know the size of the shape of hollow core regions 34, 36 and this uncertainty enhances the play of the irregular bounce ball.

The claims appended hereto are meant to cover modifications and changes within the scope and spirit of the present invention.

What is claimed is:

1. A generally spherical handball comprising:

a first spherical surface portion at a first common radial distance from a ball center point;

a second spherical surface portion at a second common radial distance from said center point;

a curvilinear edge at the abutment of said first and second spherical surface portions which causes said ball to bounce irregularly;

including a third spherical surface portion at said second common radial distance from said center point, said second and third surface portions not intersecting and a curvilinear edge at the abutment of said first and third spherical surface portions;

wherein said second and said third spherical surface portions are surfaces of two semi-spherical domes each semi-spherical dome having a different radial distance.

2. A handball as claimed in claim 1 wherein said two semispherical domes have hollow core regions.

3. A handball as claimed in claim 1 wherein said edge is less than 5% of said second common radial distance.

4. A method of playing a ball game comprising:

providing a generally spherical handball having a first spherical surface portion at a first common radial distance from a ball center point, a second spherical surface portion at a second common radial distance from said center point, and a curvilinear edge at the abutment of said first and second spherical surface portions, including a third spherical surface portion at said second common radial distance from said center point; said second and third surface portions not intersecting and a curvilinear edge at the abutment of said first and third spherical surface portions; wherein said second and said third spherical surface portions are surfaces of two semi-spherical domes each semi-spherical dome having a different radial distance;

throwing said generally spherical handball and striking a surface;

catching said generally spherical handball after an irregular bounce caused by one of the first spherical surface portion, the second spherical surface portion or the curvilinear edge striking said surface.

5. A method of playing a ball game comprising:

providing a generally spherical handball having a first spherical surface portion at a first common radial distance from a ball center point, a second spherical surface portion at a second common radial distance from said center point, a third spherical surface portion at said second common radial distance from said center point, said second and third surface portions not intersecting and a pair of curvilinear edges at the abutment of said first, second and third spherical surface portions, wherein said second and said third spherical surface portions are surfaces of two semi-spherical domes each semispherical dome having a different radial distance;

throwing said generally spherical handball and striking a surface;

catching said generally spherical handball after an irregular bounce caused by one of the first spherical surface portion, the second spherical surface portion, third spherical surface portion or the curvilinear edges striking said surface.

6. A ball game method as claimed in claim 5 wherein said second and third spherical surface portions are surfaces of semi-spherical domes, and wherein said two semi-spherical domes have hollow core regions.

* * * * *